US009347169B2

(12) United States Patent
Ahn et al.

(10) Patent No.: US 9,347,169 B2
(45) Date of Patent: May 24, 2016

(54) ADDITIVE INJECTING APPARATUS AND LAUNDRY TREATMENT MACHINE INCLUDING THE SAME

(71) Applicants: Hyukjin Ahn, Seoul (KR); Minji Kim, Seoul (KR); Sungmin Ye, Seoul (KR)

(72) Inventors: Hyukjin Ahn, Seoul (KR); Minji Kim, Seoul (KR); Sungmin Ye, Seoul (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 14/016,360

(22) Filed: Sep. 3, 2013

(65) Prior Publication Data

US 2014/0060123 A1 Mar. 6, 2014

(30) Foreign Application Priority Data

Sep. 4, 2012 (KR) ..... 10-2012-0097837

(51) Int. Cl.

| | |
|---|---|
| ***D06F 39/02*** | (2006.01) |
| ***D06F 39/00*** | (2006.01) |
| ***D06F 39/08*** | (2006.01) |
| ***D06F 58/20*** | (2006.01) |

(52) U.S. Cl.

CPC ..... *D06F 39/02* (2013.01); *D06F 39/008* (2013.01); *D06F 39/022* (2013.01); *D06F 39/088* (2013.01); *D06F 58/20* (2013.01); *D06F 58/203* (2013.01)

(58) Field of Classification Search

None

See application file for complete search history.

(56) References Cited

U.S. PATENT DOCUMENTS

| | | | | |
|---|---|---|---|---|
| 2,991,911 | A | 7/1961 | Spain | 222/67 |
| 3,401,834 | A | 9/1968 | Siegla | 222/62 |
| 4,467,627 | A * | 8/1984 | Platt | D06F 39/02 137/565.11 |
| 2007/0101773 | A1 | 5/2007 | Park et al. | 68/5 |
| 2009/0320213 | A1 * | 12/2009 | Lee | A47L 15/4234 8/159 |
| 2010/0000025 | A1 * | 1/2010 | Dalton | D06F 39/02 8/137 |
| 2011/0239480 | A1 | 10/2011 | Choi et al. | 34/68 |
| 2012/0005915 | A1 | 1/2012 | Song et al. | 34/132 |
| 2012/0047662 | A1 | 3/2012 | Koch et al. | 8/137 |

FOREIGN PATENT DOCUMENTS

| | | | |
|---|---|---|---|
| DE | 10 2007 052 076 | B3 | 1/2009 |
| EP | 2 267 209 | A1 | 12/2010 |
| KR | 10-2006-0105325 | A | 10/2006 |
| KR | 10-0765278 | B1 | 10/2007 |

OTHER PUBLICATIONS

Database WPI Week 200714; Thomson Scientific, London, GB; KR 2006-0105325 A, Oct. 11, 2006 (now Korean Patent No. 10-0765278 B1) (XP-002716848).

European Search Report dated Dec. 3, 2013 issued in Application No. 13 18 2577.

* cited by examiner

*Primary Examiner* — Michael Barr

*Assistant Examiner* — Cristi Tate-Sims

(74) *Attorney, Agent, or Firm* — KED & Associates LLP

(57) ABSTRACT

Provided are an additive injection apparatus and a laundry treatment machine including the same. The additive injection apparatus includes a main body, and additive container, a nozzle, and a floater. The main body is disposed on a path along which a solvent flows and includes an inlet and an outlet for receiving and discharging the solvent, respectively. The additive container holds an additive. The nozzle has a communicating hole for communicating between the main body and the additive container. The floater is disposed in the main body, and rises and falls according to the flow of the solvent to open and close the communicating hole.

20 Claims, 9 Drawing Sheets

ADDITIVE INJECTING APPARATUS AND LAUNDRY TREATMENT MACHINE INCLUDING THE SAME

CROSS-REFERENCE TO RELATED APPLICATION(S)

This application claims priority under 35 U.S.C. §119 to Korean Application No. 10-2012-0097837 filed on Sep. 4, 2012, whose entire disclosure is hereby incorporated by reference.

BACKGROUND

1. Field

The present application relates to an additive injecting apparatus and a laundry treatment machine including the additive injection apparatus.

2. Background

Generally, an additive injecting apparatus is an apparatus that injects an additive to a solvent. For example, solvents such as water, alcohol, benzene, acetone, and ether are used in laundry treatment machines such as washing machines, drying machine, washing & drying machines, and refreshers which perform washing, rinsing, drying, and refreshing cycles on laundry such as clothing and bedding. Recently, laundry treatment machines with an additional function of spraying steam generated by heating a solvent are being widely used. Laundry can be treated according to the characteristics of the additives by injecting a certain additive to the solvents. Additives can be provided in a form of water-soluble or oil-soluble liquid or powder according to the characteristics of the solvents.

Examples of additives include additives for washing such as detergent, fabric softener, and bleach, anti-scale agent for preventing scale from being generated on a flow path of a solvent, air freshener, anti-rust additive, oxidizing/reducing agent for maintaining an appropriate level of PH, sterilizer, and dispersing agent.

These additives can be injected at a time, but needs to be uniformly injected little by little in accordance with their purpose. For example, since the anti-scale agent needs to continuously act on the movement path of the solvent, it is more important to inject the anti-scale agent little by little than inject a large amount of anti-scale agent at a time.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
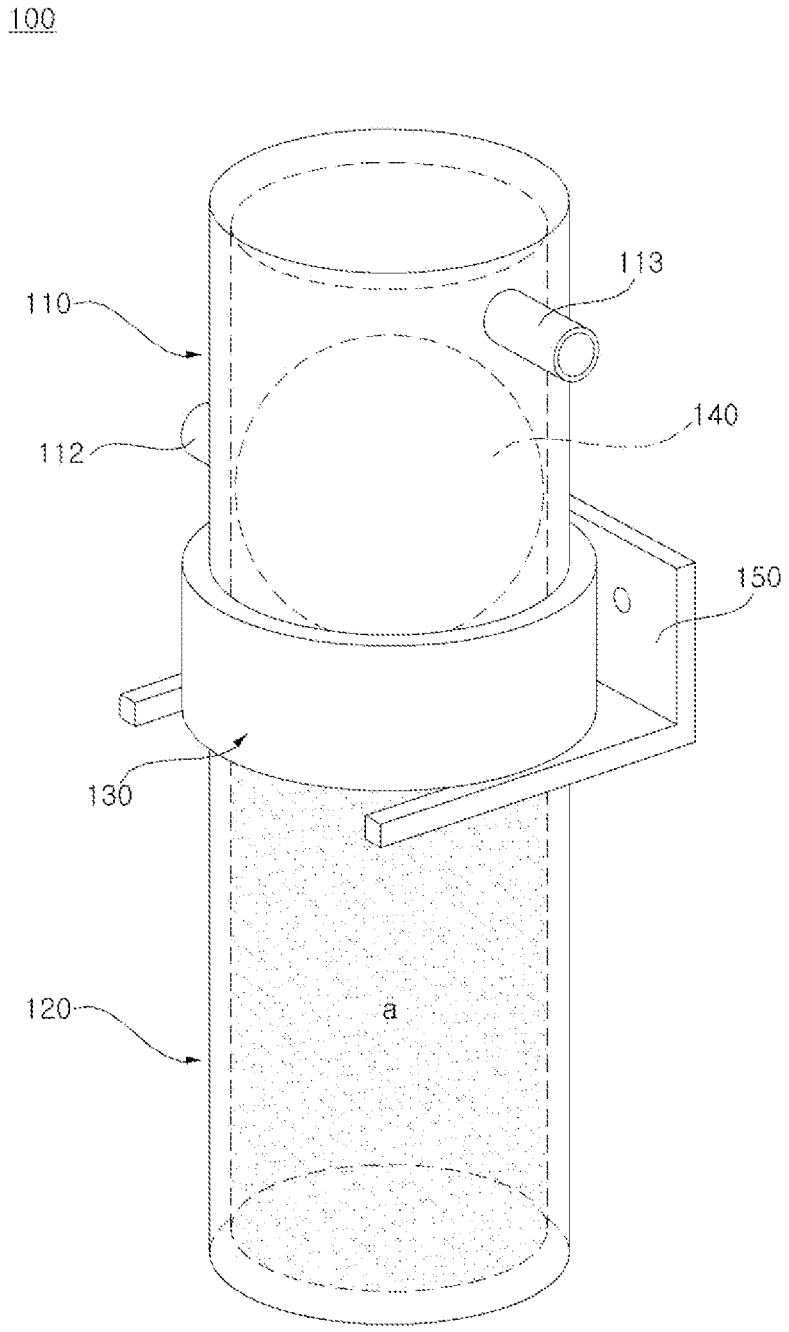
FIG. 1 is a view illustrating an additive injecting apparatus according to an embodiment of the present application.
Figure 2:
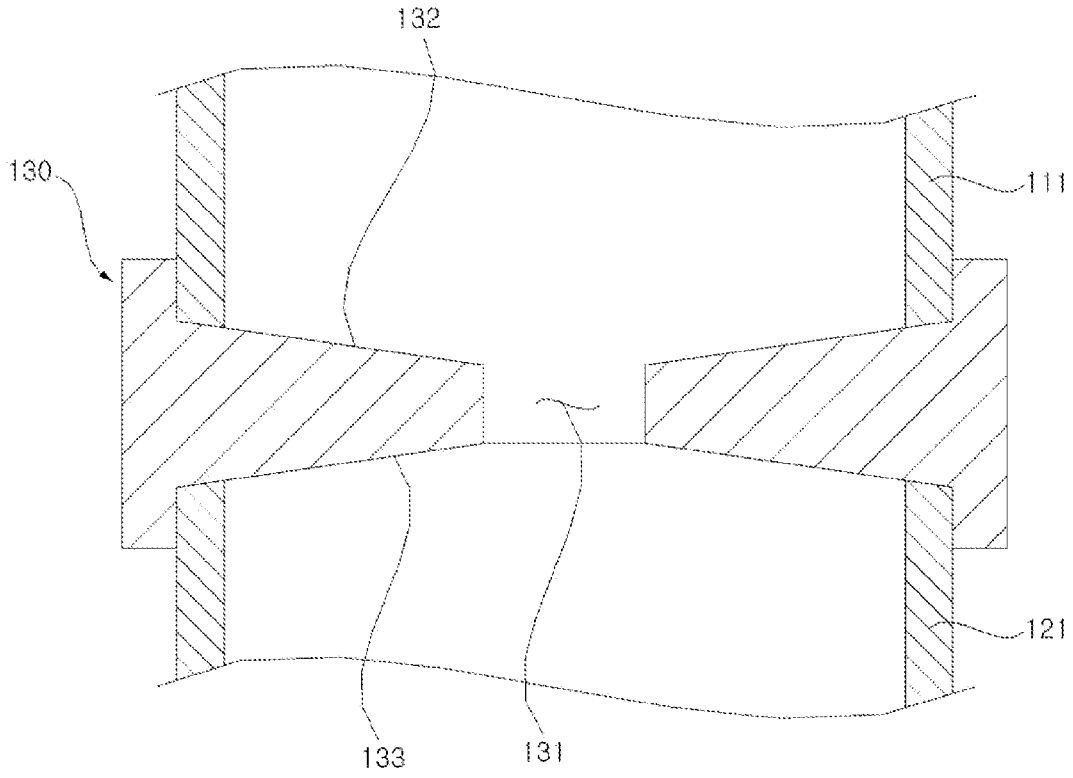
FIG. 2 is a view illustrating an exemplary nozzle part shown in FIG. 1.

FIG. 1 is a view illustrating an additive injecting apparatus according to an embodiment of the present application. FIG. 2 is a view illustrating an exemplary nozzle part shown in FIG. 1.

Referring to FIG. 1, an additive injecting apparatus 100 according to an embodiment of the present application may include a main body 110 including an inlet 112 and an outlet 113 for receiving and discharging a solvent, respectively, an additive container 120 for holding an additive, a nozzle 130 including a communicating hole 131 for communicating between the main body 110 and the additive container 120, and a floater 140 disposed in the main body 110 to open or close the communicating hole 131 by rising and falling according to the flow of the solvent.

The additive injection apparatus 100 may inject the additive into the solvent flowing along a certain flow passage. For example, laundry treatment machines such as washing machines, drying machines, washing & drying machines, and refreshers may include a solvent supply passage (see supply pipe 74 of FIG. 4) for supplying an organic solvent for dry cleaning or spot removal or water to clothing or bedding (hereinafter, referred to as laundry) that is a target to be treated. The additive injection apparatus 100 may be disposed on the solvent supply passage. Thus, while the solvent is flowing along the solvent supply passage, the additive may be injected. The additive may be appropriately injected according to the treatment purpose of laundry. For example, the additives may include anti-scale agent, detergent, fabric softener, bleach, oxidizing/reducing agent for maintaining an appropriate level of PH, sterilizer, dispersing agent, and surfactant. The injected additive may have appropriate liquid properties such as water solubility, oil solubility, acidity, alkalinity, and neutrality, and may have morphological characteristics of liquid, particle, or the like (see a of FIG. 1).

The main body 110 may receive a solvent through the inlet 112 connected to the solvent supply passage, and may discharge the solvent through the outlet 113. In this case, the floater 140 may be raised by a stream pressure, allowing the communicating hole 131 to be opened. The center point of the inlet 112 for receiving the solvent is located at a horizontal level below the center of the floater 140. In this case, a portion of the solvent may be introduced into the additive container 120, and may dissolve the additive. Solvent with the additive dissolved may be supplied to the main body through the communicating hole 131. This process may be mainly performed by a diffusion action due to a concentration gradient between the main body 110 and the additive container 120. However, the additive may maintain an appropriate difference of the specific gravity from the solvent. Thus, the additive may have a specific gravity greater than that of the solvent such that the additive stays in the additive container 120 until the dissolution between the additive and the solvent is performed. Herein, the specific gravity is defined as the ratio of the weight of a volume of a substance to the weight of an equal volume of distilled water at 4° C.

The additive held in the additive container 120 may have a particle size smaller than the area of the communicating hole 131, or although the additive is liquid, the whole amount of additive is not used up at a time. This is because it is possible to maintain the amount transferred from the additive container 120 to the main body 110 through the communicating hole 131 relatively smaller than the discharge amount of the outlet 113, by appropriately adjusting the pressure of solvent received through the inlet, the flow rate of solvent passing the inlet 112 or the outlet 113, and the area of the communicating hole 131.

The floater 140 may smoothly rise due to the buoyancy when the specific gravity of the floater 140 is smaller than the solvent. However, in this case, even when the solvent supply is stopped, the floater 140 may be maintained at a raised state by a residual solvent in the solvent supply passage or the main body 110, causing the additive to be excessively spent. Accordingly, the specific gravity of the floater 140 may be allowed to be larger than that of solvent such that the floater 140 can be maintained to close the communicating hole 131 at the falling location if the solvent does not flow even though the solvent is filled in the main body 110. When the solvent is water, the floater 140 may be formed of a material, e.g., synthetic resin such as polycarbonate (PC) or acrylonitrile-butadiene-styrene copolymer (ABS) having a specific gravity larger than water.

The inlet 112 may be formed at a location lower than that of the outlet 113. In this case, due to a height difference between the inlet 112 and the outlet 113, a certain degree of rising stream may be formed to allow the floater 140 to smoothly rise.

The reference numeral 150 indicates a coupling bracket. The coupling bracket 150 may fix the additive injection apparatus 110 to the casing or the like.

Referring to FIG. 2, the nozzle 130 may include an inclination forming part 132 that inclines toward the communicating hole 131 such that the floater 140 can be located just on the communicating hole 131 when falling. When the solvent supply is stopped, the floater 140 may be downwardly converged to the communicating hole 131 along the inclination forming part 132, interrupting the injection of the additive.

Meanwhile, the nozzle 130 may include a convergent part 133 forming an inclination surface that converges to the communicating hole 131 such that dissolved components in the additive container 120 can be smoothly guided to the communicating hole 131 together with the solvent. In a structure in which the main body 110 is located over the additive container 120, the convergent part 133 may be formed at the lower portion of the nozzle, i.e., at the opposite side of the inclination forming part 132.

FIGS. 3A through 3D are views illustrating other exemplary nozzles. Hereinafter, nozzles according to other embodiments will be described with reference to FIGS. 3A to 3D.

In the above description, it should be understood that the closed state of the floater 140 with respect to the communicating hole 131 at the falling location does not necessarily mean a fully sealed state of the communicating hole 131, and may include a case where a certain gap exists between the floater 140 and the communicating hole 131. Particularly, in order to allow the solvent to quickly flow into the additive container 120 at an initial stage of solvent supply, it is desirable that a certain gap exists between the floater 140 and the communicating hole 131 even when the floater 140 is located at the falling location. In another aspect, this structure may contribute to smooth rising of the floater 140 by reducing the contact area between the floater 140 and the communicating hole 131 and thus reducing the viscous frictional force between the floater 140 and the communicating hole 131.

For this, the communicating hole 131 may include non-contact sections 231*a*, 331*a*, 431*a* and 531*a* with the floater 140 at the falling location of the floater 140. At the falling location of the floater 140, the additive container 120 and the main body 110 may communicate with each other through the non-contact section 231*a*, 331*a*, 431*a* and 531*a*. FIGS. 3A to 3D show that gaps exist between the section C of the floater 140 and the non-contact sections 231*a*, 331*a*, 431*a* and 531*a* over the same position plane as the communicating hole 131.

Figure 3A:
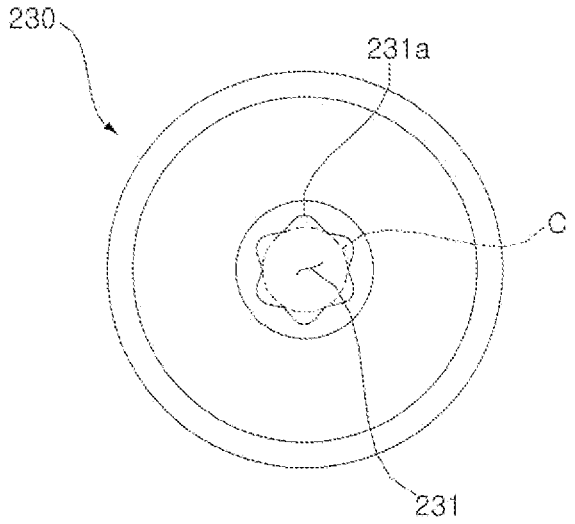
FIGS. 3A through 3D are views illustrating other exemplary nozzle parts.
Figure 3B:
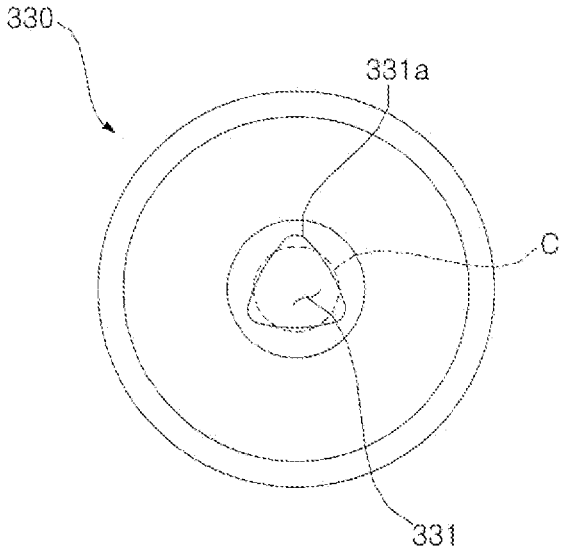

According to embodiments, the floater 140 may have a spherical shape, and the communicating hole 131 may be non-circular to reduce the contact area with the floater 140 (see FIGS. 3A and 3B).

Figure 3C:
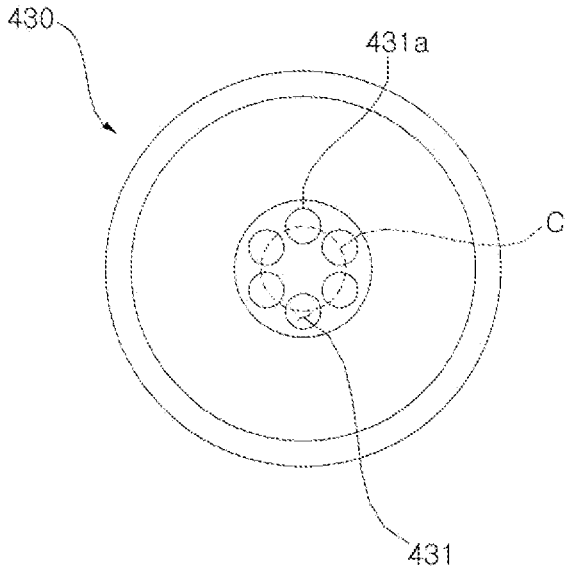
Figure 3D:
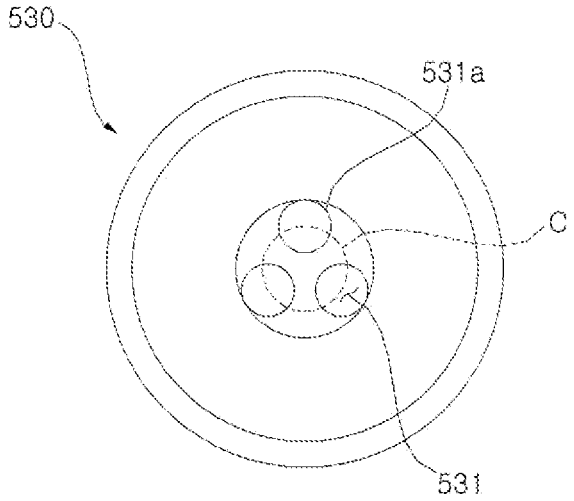

Referring to FIGS. 3C and 3D, the communicating hole 131 may be formed in plurality. Since the floater 140 is also supported between the communicating holes 131, the floater 140 may not adhere fully to the communicating hole 131. Accordingly, compared to a case where the communicating hole 131 is formed in singularity, the non-contact sections 431*a* and 531*a* can increase.

Figure 4:
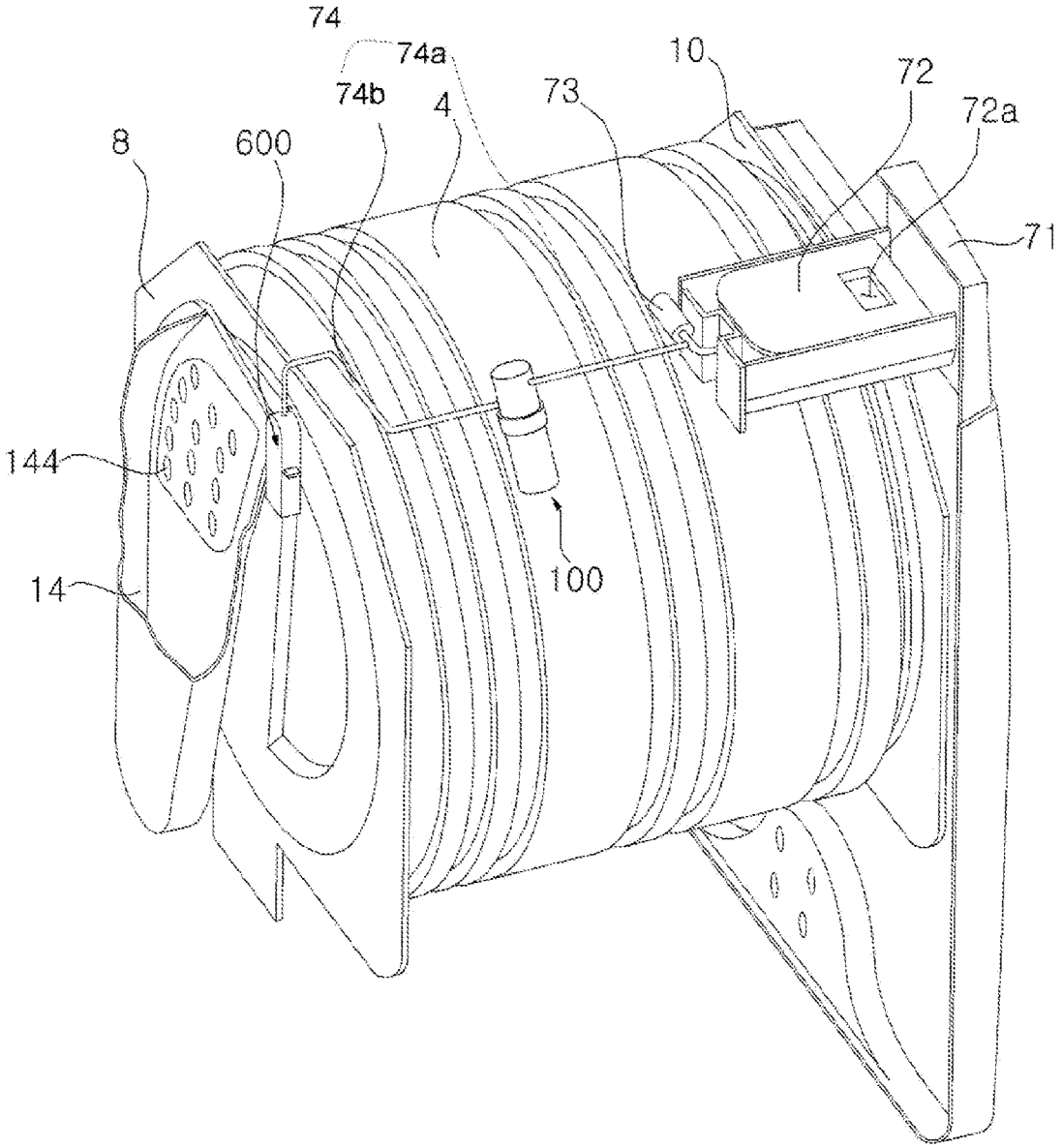
FIG. 4 is a view illustrating a laundry treatment machine according to an embodiment of the present application.
Figure 5:
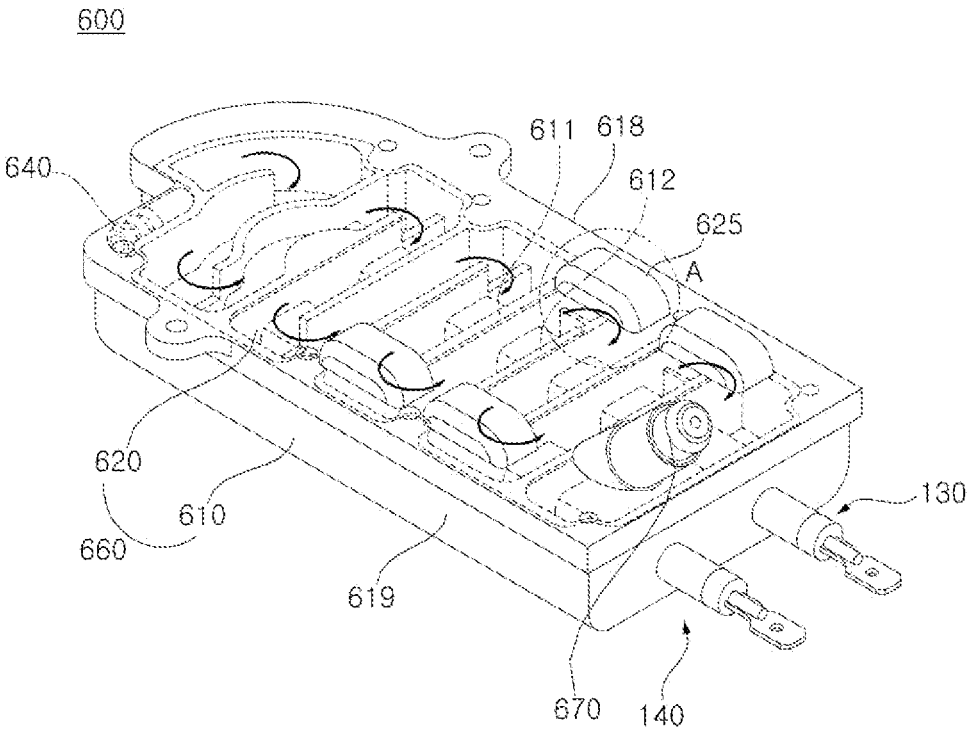
FIG. 5 is a view illustrating a spray apparatus shown in FIG. 4.
Figure 6:
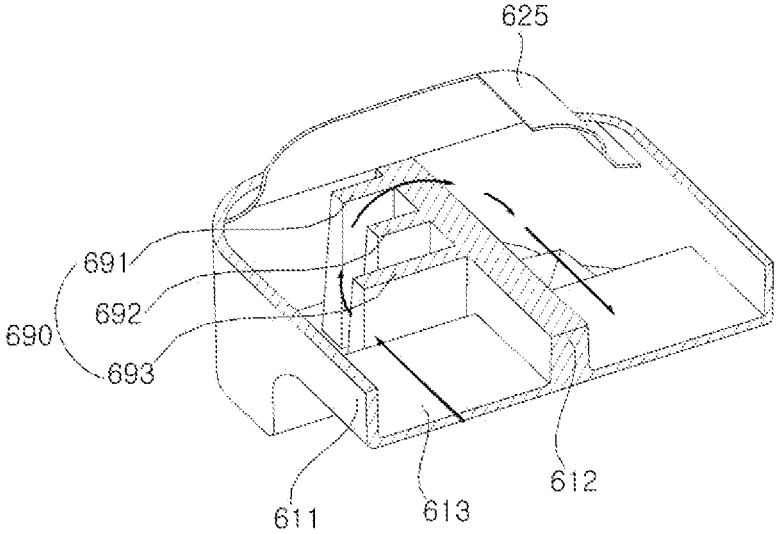
FIG. 6 is a cross-sectional view illustrating a portion A of FIG. 5.

FIG. 4 is a view illustrating a laundry treatment machine according to an embodiment of the present application. FIG. 5 is a view illustrating a spray apparatus shown in FIG. 4. FIG. 6 is a cross-sectional view illustrating a portion A of FIG. 5.

Referring to FIGS. 4 to 6, a laundry treatment machine (hereinafter, exemplified as a drying machine, but embodiments are not limited thereto) according to an embodiment of the present application may include a drum 4 rotatably disposed therein and holding laundry and a spray apparatus 600 spraying water into the drum 4.

The spray apparatus 600 may include a flow passage forming unit 660 comprising a flow passage guiding water introduced through the inlet 613 to a nozzle 670, a steam generating heater 630 applying heat to water flowing along the flow passage forming unit 660, and the nozzle 670 spraying heated water in addition to steam generated while water is flowing along the flow passage in the flow passage forming unit 660.

In this embodiment, a separate water receiver 72 may be provided, and an additive injection apparatus 100 may be disposed on a water supply pipe 74 connected to the water receiver 72. The inlet 112 of the additive injection apparatus 100 may receive water from the water receiving unit 72 through a water supply pipe 74*a*, and the outlet 113 of the additive injection apparatus 100 may be connected to the spray apparatus 600 through a water supply pipe 74*b*. A pump 73 may be provided on the water supply pipe 74*a* to forcibly transfer water from the water receiving unit 72 to the additive injection apparatus 100.

On the other hand, the flow passage forming unit 660 may also be supplied with water from an external water source such as a faucet. In this case, a water supply hose connected to the external water resource may be connected to the inlet 112 of the solvent injection apparatus 600, and a valve may be further provided between the inlet 112 and the water supply hose to control water supply. A filter may be further provided to filter foreign substances from supplied water.

The flow passage forming unit 660 may be integrally coupled to the nozzle 670. Here, the meaning of the integral coupling may include a case where the flow passage forming unit 660 and the nozzle 670 are formed into one member by injection molding as well as a case where the flow passage forming unit 660 and the nozzle 670 are separately formed and then form one unit or module. In either case, the location of the nozzle 670 may be determined by the fixed location of the flow passage forming unit 660.

A typical structure in which water is held and heated in a certain container to generate steam and the steam is transferred to the spray nozzle through the hose has a limitation in that the steam can be condensed and the condensate water can be sprayed through the nozzle, wetting the drying subject again. However, according to an embodiment of the present application, water may be heated while flowing through the flow passage unit 660, and steam may be sprayed through the nozzle 670 formed integrally with the flow passage forming unit 660. Accordingly, it can be fundamentally prevented that steam is condensed while steam generated in the flow passage forming unit 660 is flowing to the nozzle 670.

The water receiving unit 72 may be disposed in the drawer 71. A user may withdraw the drawer 71, and may supply water through a loading hole 72*a*. Particularly, in case of a laundry treatment machine miniaturized in consideration of mobility, it is advantageous to receive water through the water receiving unit 72 rather than receive water from an external water source.

The flow passage forming unit 660 may include a flow passage main body 610 and a cover 620. The flow passage main body 610 may include a flow passage for guiding water from the inlet 613 to the nozzle 670, and may have an upper portion opened. The cover 620 may cover the opened upper portion of the flow passage main body 610. According to embodiments, the flow passage main body 610 and the cover 620 may be integrally formed. The flow passage main body 610 may have the inlet 613 connected to the water supply pipe 74. Water may be introduced into the flow passage main body 610 through the inlet 613.

The steam generating heater 630 may heat water introduced into the flow passage main body 610. Water may be heated to generate steam according to the heating of the steam generating heater 630. The steam generating heater 630 may be exposed to the flow passage in which water flows, but in this embodiment, will be exemplified as being buried in a bottom 613 of the flow passage main body 610. Since the steam generating heater 630 is not directly exposed to water, there is an advantage in that a separate insulating structure for the insulation of the steam generating heater 630 is unnecessary. The flow passage main body 610 may be formed of a thermal conductive material such as aluminum, such that heat transfer from the steam generating heater 630 can be easily performed.

The steam generating heater 630 may include two terminals 631 and 632 for power supply. The terminals 631 and 632 may outwardly protrude from the flow passage main body 610 to be electrically connected to a power supply.

The flow passage main body 610 may form a certain space such that water can be moved to the inside thereof. A plurality of flow passage forming ribs 611 and 612 may be protrusively formed on the bottom 613 of the flow passage main body 610 to form a path along which water moves. The plurality of flow passage forming ribs may extend between a right side portion 118 and a left side portion 119 of the flow passage main body 610.

Water supplied through the inlet 613 may be guided along the plurality of flow passage forming ribs 611 and 612. The traveling direction of water may be alternately switched while flowing to the nozzle 670.

The cover 620 may cover the flow passage main body 610, and may be formed integrally with the flow passage main body 610 or may be coupled to the flow passage main body 610 by a coupling member. In this case, sealing may be performed between the cover 620 and the flow passage main body 610 such that steam generated in the flow passage main body 610 is not leaked.

An outlet may be formed on the cover 620 to discharge water flowing along the flow passage forming ribs 611 and 612. The outlet may be coupled to nozzle 670.

Meanwhile, the flow passage forming unit 660 may include a plurality of flow passage forming ribs 611 and 612 protruding from the bottom 613, and may be divided into both spaces based on one of the flow passage forming ribs 611 and 612. Also, the passage forming unit 660 may have a gap for movement of water at an upper side of the flow passage forming rib 612 such that water can overflow the flow passage forming rib 612 while traveling from one of the both spaces pertaining to upstream side to the other space pertaining to downstream side. In order to provide the gap for the movement of water, a gap forming section 625 may be formed in the cover 620. In the gap forming section 625, the inner side surface of the cover 620 may be spaced from the flow passage forming rib 612.

An impactor 690 may be provided in the flow passage forming unit 660, and may extend from the flow passage forming rib 612. The impactor 690 may protrude in plurality toward the space pertaining to the upstream side among the both spaces based on the flow of water.

The impactor 690 may be formed at a location corresponding to the gap forming section 625. Water flowing in the flow passage forming unit may be hit by the impactor 690 at the space pertaining to the upstream side of the both spaces divided by the flow passage forming rib 612, and then may travel to the space pertaining to the downstream side through the gap forming section 625. When this process is continuously repeated, scale may be mainly generated among the impactors 691, 692 and 693. Accordingly, the spray hole of the nozzle 670 can be prevented from clogging.

The impactor 690 may be formed at a plurality of locations, particularly, at sections where the flow direction is switched. The flow passage forming rib may be partially cut such that the water flow can travel even though the gap forming section 625 is not formed at a section where the impactor 690 is not installed among the sections where the flow direction is switched.

Although not shown, the spray apparatus 600 may be configured such that the inlet 640 is disposed over the nozzle 670. This structure is advantageous to discharging of residual water in the flow passage forming unit 660.

The structure in which the traveling direction of water is alternately switched between the flow passage forming ribs 611 and 612 may apply sufficient heat to water flowing along the flow passage by lengthening the traveling distance of water. Particularly, when comparing with a case where steam is generated by heating water held in a certain place, this embodiment has an effect of significantly reducing time necessary in steam spraying compared to a related art because heat is applied to flowing water and thus the phase change is achieved.

Also, since water is heated while moving along the flow passage forming unit 660, a portion of water is phase-changed into steam, but another portion of water may reach the nozzle 670 in a liquid state. Accordingly, water sprayed through the nozzle 670 may be in a state that liquefied water and gaseous water (steam) are mixed. Preferably, during the spraying through the nozzle 670, the temperature at the outlet or the inlet of the nozzle 670 may be maintained at about 70 degrees Celsius (hereinafter, unit of temperature is Celsius), and the internal temperature of the drum 4 may be maintained at a temperature range from about 30 degrees to about 40 degrees. In a typical type in which only steam is spray, since the temperature of steam is too high, clothing may be directly damaged and secondary contamination may occur due to denaturalization of spots. However, in this embodiment clothing is not damaged while a certain level of spray pressure is maintained.

The spray pressure of the nozzle 670 may also be closely related with the diameter of the spray hole of the nozzle 670. When the diameter of the spray hole is greater than about 1.5 mm, water sprayed from the nozzle 670 may not hit or reach laundry with a sufficient strength. On the other hand, when the diameter of the spray hole is smaller than about 1 mm, the amount of spray may be insufficient to treat clothing. Also, as the diameter of the spray hole decreases, the possibility of the clogging of the spray hole may increase due to scale. Accordingly, in consideration of various factors, the diameter of the spray hole of the nozzle 670 may range from about 1.5 mm to about 2 mm. In this case, the nozzle 670 may spray water of about 70 cc to about 120 cc per minute.

Also, since water keeps absorbing heat while flowing along a narrow flow passage defined as a gap between the flow passage forming ribs 611 and 612, when the water flow is divided into upstream and downstream according to the traveling direction from the inlet 640 to the nozzle 670, downstream water may be prone to phase change due to much heat-absorbing time, and upstream water may also rapidly generate steam at a portion contacting the bottom 613, where a high temperature and pressure state is generated due to a water pressure according to the flowing of the water in addition to the steam, and a high pressure may act from upstream to downstream. Accordingly, steam finally sprayed through the nozzle 670 may be maintained at a very high pressure, and can reach a drying subject in the drum 4.

That is, since the spray apparatus 600 can generate and spray steam in a short time, time spent on the steam spray cycle can be reduced, and the power consumption can also be reduced. Also, steam can be sprayed at a high temperature and pressure.

Meanwhile, in the additive injection apparatus 100, water supplied through the water supply pipe 74 may flow from the inlet 112 to the outlet 113 in the main body 110. In this process, the floater 140 may rise and thus the additive may be injected. Thus, water with the additive dissolved therein may be supplied to the spray apparatus 600. As described above, the additive injection apparatus 100 can inject various kinds of additives, and particularly, can inject an anti-scale agent (see a of FIG. 1) to prevent scale from being generated in the spray apparatus 600.

The anti-scale agent may include polyphospates and oxygen-binding agent, chelate agent, and dispersion agent, and may include hydroxy etylene diphosphonic acid (HEDP) that precipitates and dissolves Ca and Mg components and adsorbs amorphous precipitate crystals such as needle shape and snowy shape.

As another example, the anti-scale agent may include effect-proven tetrasodium ethylenediaminetetraacetec acid (EDTA) that prevents the generation of scale by precipitating hardness components of solvent, disperses already-generated scale by a strong dispersion action, prevents corrosion by chemically reacting with dissolved oxygen, and maintains an optimum PH by melting alkaline substances.

The additive injection apparatus according to the embodiment of the present application has an effect of injecting an additive to a solvent at a uniform concentration.

Also, since the additive injection apparatus allows an additive to be injected only when a solvent flows, an appropriate amount of additive can be spent only when necessary.

The present application provides an additive injecting apparatus and a laundry treatment machine including the same, which can uniformly inject an additive to a solvent.

The present application also provides an additive injecting apparatus and a laundry treatment machine, which automatically injects additives according to the flow of a solvent.

According to an aspect of the present application, there is provided an additive injection apparatus comprising: a main body disposed on a path along which a solvent flows and comprising an inlet and an outlet for receiving and discharging the solvent, respectively; an additive container holding an additive; a nozzle having a communicating hole for communicating between the main body and the additive container; and a floater disposed in the main body and rising and falling according to the flow of the solvent to open and close the communicating hole.

The main body may be disposed over the additive container.

The floater may have a specific gravity larger than the solvent.

The center point of the inlet for receiving the solvent is located at a horizontal level below the center of the floater.

The nozzle may include an inclination forming part that inclines toward the communicating hole such that the floater downwardly converges to the communicating hole.

The floater may have a spherical shape, and the communicating hole may be non-circular to reduce a contact area with the floater.

The communicating hole may have a non-contact section between the communicating hole and the floater such that the additive container partially communicates with the main body at a falling location of the floater.

The additive container may include a convergent part forming an inclination surface that converges to the communicating hole such that a component with the additive dissolved therein is guided to the communicating hole together with the solvent.

The communicating hole may be formed in plurality.

The additive may be an anti-scale agent.

The anti-scale agent may include hydroxy etylene diphosphonic acid (HEDP).

The anti-scale agent may include ethylenediaminetetraacetec acid (EDTA).

The additive may have a specific gravity larger than the solvent.

According to another aspect of the present application, there is provided a laundry treatment machine comprising: a spray apparatus for spraying a solvent; and an additive injection apparatus for injecting an additive into the solvent supplied to the spray apparatus, and wherein the additive injection apparatus comprises: a main body disposed on a path along which the solvent flows and comprising an inlet and an outlet for receiving and discharging the solvent, respectively; an additive container holding the additive; a nozzle having a communicating hole for communicating between the main body and the additive container; and a floater disposed in the main body and rising and falling according to the flow of the solvent to open and close the communicating hole.

The spray apparatus may include: a flow passage forming unit comprising an inlet receiving the solvent passing the additive injection apparatus, an outlet discharging the solvent, and a flow passage guiding the solvent from the inlet to the outlet; a steam generating heater applying heat to the solvent moving along the flow passage forming unit; and a nozzle connected to the outlet to spray steam generated by heating of the steam generating heater together with the liquefied solvent.

The additive container may hold an anti-scale agent.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An additive injection apparatus for a laundry treating machine, comprising:

a main body disposed on a path along which a solvent flows and including an inlet and an outlet for receiving and discharging the solvent, respectively;

an additive container, disposed underneath the main body, for holding an additive;

a communicating element for communicating between the main body and the additive container; and a floater disposed in the main body, the floater to rise according to the flow of the solvent to open the communicating element, and the floater to fall according to the flow of the solvent to close the communicating element, wherein the floater is configured to be raised, by the flow of the solvent, from the inlet to the outlet to allow the communication element to be opened.

2. The additive injection apparatus of claim 1, wherein the floater has a specific gravity greater than water.

3. The additive injection apparatus of claim 1, wherein the communicating element includes a nozzle, and wherein the nozzle includes a communication hole and an inclination toward the communicating hole such that the floater is urged toward the communicating hole.

4. The additive injection apparatus of claim 3, wherein the floater has a spherical shape, and the communicating hole is non-circular to reduce a contact area with the floater.

5. The additive injection apparatus of claim 3, wherein the communicating hole has a non-contact section with the floater such that the additive container is in communication with the main body.

6. The additive injection apparatus of claim 3, wherein the nozzle includes a further inclination that converges upward to the communicating hole.

7. The additive injection apparatus of claim 3, wherein the communicating hole is formed in plurality.

8. The additive injection apparatus of claim 1, wherein the additive has a specific gravity greater than water.

9. The additive injection apparatus of claim 1, wherein the inlet is arranged lower than the outlet.

10. A laundry treatment machine comprising:

a spray apparatus for spraying a solvent into a drum; and the additive injection apparatus according to any of preceding claims 1-9.

11. The laundry treatment machine of claim 10, wherein the spray apparatus comprises:

a flow passage forming unit including an inlet for receiving the solvent passing the additive injection apparatus, an outlet for discharging the solvent, and a flow passage for guiding the solvent from the inlet to the outlet;

a steam generating heater configured for applying heat to the solvent moving along the flow passage to form stream; and a nozzle arranged on the outlet to spray the generated steam.

12. An additive injection apparatus for a laundry treating machine, comprising:

a body having an inlet to receive a solvent and having an outlet to discharge the solvent;

an additive container at the body to store an additive;

a communicating element between the body and the additive container; and a floater in the body to change from a first position to a second position and to open the communicating element when solvent is received in the body via the inlet, and the floater to change from the second position to the first position when the solvent is not received at the inlet.

13. The additive injection apparatus of claim 12, wherein the floater has a specific gravity greater than the solvent.

14. The additive injection apparatus of claim 12, wherein the communicating element includes a nozzle, and wherein the nozzle includes a communication hole and a first inclination toward the communicating hole such that the floater is urged toward the communicating hole.

15. The additive injection apparatus of claim 14, wherein the floater has a spherical shape, and the communicating hole is non-circular to reduce a contact area with the floater.

16. The additive injection apparatus of claim 14, wherein the communicating hole has a non-contact section with the floater such that the additive container is in communication with the body.

17. The additive injection apparatus of claim 14, wherein the nozzle includes a second inclination that converges upward to the communicating hole.

18. The additive injection apparatus of claim 14, wherein the communicating hole is provided in plurality.

19. The additive injection apparatus of claim 12, wherein the additive has a specific gravity greater than water.

20. The additive injection apparatus of claim 12, wherein the inlet is arranged lower than the outlet.

* * * * *